US011325799B2

(12) United States Patent
Herrmann et al.

(10) Patent No.: US 11,325,799 B2
(45) Date of Patent: May 10, 2022

(54) INTERDIGITATED VACUUM ROLL SYSTEM FOR A CUT SHEET PRINTER DRYER TRANSPORT

(71) Applicant: Xerox Corporation, Norwalk, CT (US)

(72) Inventors: Douglas K. Herrmann, Webster, NY (US); Seemit Praharaj, Webster, NY (US); Michael J. Levy, Webster, NY (US); Jason M. Lefevre, Penfield, NY (US); Paul McConville, Webster, NY (US); Chu-heng Liu, Penfield, NY (US); Linn C. Hoover, Webster, NY (US); David A. VanKouwenberg, Avon, NY (US)

(73) Assignee: Xerox Corporation, Norwalk, CT (US)

( * ) Notice: Subject to any disclaimer, the term of this patent is extended or adjusted under 35 U.S.C. 154(b) by 0 days.

(21) Appl. No.: 16/570,577

(22) Filed: Sep. 13, 2019

(65) Prior Publication Data

US 2021/0078814 A1 Mar. 18, 2021

(51) Int. Cl.
*B65H 5/22* (2006.01)
*B65H 5/06* (2006.01)

(52) U.S. Cl.
CPC ..... *B65H 5/222* (2013.01); *B65H 5/066* (2013.01)

(58) Field of Classification Search
CPC ..... B65H 5/222; B65H 5/066; B65H 3/08; B65H 3/085; B65H 3/12; B65H 3/122
See application file for complete search history.

(56) References Cited

U.S. PATENT DOCUMENTS 2,625,865 A * 1/1953 Taini ..... G03D 7/00 34/663
3,045,791 A * 7/1962 Ayres ..... B65G 13/12 193/35 F
3,696,912 A * 10/1972 Fleischauer ..... B65G 47/263 198/781.1
3,754,752 A * 8/1973 Thayer ..... B65H 3/122 271/132
4,045,015 A * 8/1977 Sardella ..... B65H 3/063 271/112

(Continued)

FOREIGN PATENT DOCUMENTS

JP 2018-127351 * 8/2018

OTHER PUBLICATIONS

Xerox Brenva HD Production Inkjet Press Overview; Xerox Corporation; 2016; 11 pages.

(Continued)

*Primary Examiner* — Thomas A Morrison
(74) *Attorney, Agent, or Firm* — Ortiz & Lopez, PLLC; Kermit D. Lopez; Luis M. Ortiz

(57) ABSTRACT

A vacuum roller system and a method of operation the vacuum roller system can include an assembly of interdigitated rollers, and a vacuum system, wherein the assembly of interdigitated rollers is operably connected to the vacuum system to move sheets of media through a downstream dryer in a printer, wherein a vacuum is drawn between individual rollers among the assembly of interdigitated rollers so that the vacuum is distributed across a sheet of media and is split around the individual rollers. The spacing between the individual rollers among the assembly of interdigitated rollers is variable to vary the vacuum.

19 Claims, 15 Drawing Sheets

(56) References Cited

U.S. PATENT DOCUMENTS 4,315,722 A * 2/1982 Ufermann ..... B27N 3/143 425/83.1
4,681,203 A * 7/1987 Kornylak ..... B65G 13/11 193/35 R
4,681,311 A * 7/1987 Sardella ..... B65H 3/063 271/102
5,000,438 A * 3/1991 Sardano ..... B65H 3/68 198/735.3
5,004,218 A * 4/1991 Sardano ..... B65H 3/46 221/231
5,006,042 A * 4/1991 Park ..... B65H 3/063 198/577
5,011,124 A * 4/1991 Sardano ..... B65H 3/5238 271/121
5,050,852 A * 9/1991 Sawada ..... B65H 3/063 271/11
6,829,969 B1 * 12/2004 Sullivan ..... B65H 7/18 83/298
7,635,124 B2 * 12/2009 Sardella ..... B65H 3/042 271/10.06
8,419,144 B2 4/2013 Castillo et al.
8,434,761 B2 * 5/2013 Ruiz ..... B65H 5/066 271/194
8,622,504 B2 1/2014 Uchida
8,746,832 B2 6/2014 Rosati et al.
8,777,216 B2 * 7/2014 Otsuka ..... B65H 7/16 271/194
8,953,972 B2 2/2015 Izawa et al.
9,056,473 B2 6/2015 Rosati et al.
10,035,361 B2 7/2018 Lyon et al.
10,232,647 B2 3/2019 Balala et al.
10,350,912 B1 7/2019 Herrmann et al.
10,353,652 B2 7/2019 Herrmann et al.
10,358,307 B1 7/2019 Liu et al.
2005/0012239 A1 * 1/2005 Nakashima ..... B29C 41/28 264/216
2013/0300053 A1 * 11/2013 Otsuka ..... B65H 29/24 271/103
2017/0057766 A1 * 3/2017 Kodama ..... B65H 7/20
2017/0066595 A1 * 3/2017 Fourney ..... B65G 21/2054
2018/0117934 A1 5/2018 Herrmann
2019/0056895 A1 2/2019 Herrmann et al.
2020/0023603 A1 * 1/2020 Akita ..... B65H 1/06

OTHER PUBLICATIONS

Xerox Brenva HD Production Inkjet Press brochure; Xerox Corporation; 2018; 2 pages.

* cited by examiner

INTERDIGITATED VACUUM ROLL SYSTEM FOR A CUT SHEET PRINTER DRYER TRANSPORT

TECHNICAL FIELD

Embodiments are related to printing systems. Embodiments also relate to transports, transport belts, radiant dryers and other components utilized in printing systems. Embodiments further relate to an interdigitated vacuum roll system for use with a cut sheet printer dryer transport in a printing system.

BACKGROUND

Printing systems known in the document reproduction arts can apply a marking material, such as ink or toner, onto a substrate such as a sheet of media of such as paper, a textile, metal, plastic and objects having a non-negligible depth such as a coffee cup, bottle, and the like.

A printing system (which can also referred to simply as a printer) can perform printing of an image or the like on sheets of paper, for example, by transporting a sheet of paper (or other media substrates), which is an example of a medium, up to a position of a printing section using a transport roller, and an endless form transport belt, which can rotate while coming into contact with the sheet of paper, and discharging ink, which is an example of a liquid, toward the sheet of paper from a liquid discharging head.

Such printing systems typically utilize an ink jet dryer such as a radiant dryer and a vacuum belt system to transport ink jet media through the radiant dryer. FIG. 1 illustrates an image of a prior art vacuum belt transport system 112 utilized in some printing systems. As shown in FIG. 1, the vacuum belt transport system 112 includes a belt 114, a belt 116, a belt, 118, a belt 120, and a belt 122, which each include belt holes. FIG. 2 illustrates an image depicting a close-up view of a prior art holes/plenum configuration utilized in some printing systems. FIG. 3 illustrates an image depicting a vacuum hole defects caused by prolonged contact of media to a transport belt during drying in some printing systems. Note that in FIGS. 1-3 identical or similar parts are indicated by identical or similar reference numerals.

Because the vacuum belt transport system 112 and the sheet of media transit the dryer system at the same speed, there is no relative motion between the belt and the media. The belt holes and each of the belts 114, 116, 118, 120, 122 have different properties and during the drying phase this can manifest in differential drying of the ink and image defects.

Current ink sets are designed to print black, cyan, magenta, and yellow. The current set of inks (Cyan, Magenta, Yellow & Black) that have been selected for use in some printing systems may suffer from differential drying when being transported through the radiant dryer. Due to the fact that the sheets of media enter and transit the dryer when the image is not dry, nip rollers may not be used in such situations.

This has led to the use of vacuum belt systems that create drive on the bottom of the sheet of media. Such vacuum belt systems may include a belt that creates this drive through the use of a plenum and holes in each belt that transfer the vacuum force to the backside of the media.

While this can facilitate the necessary drive, it can leave the media in direct contact with a specific region of the belt for the entire time it transits through the dryer. The media does not move relative to the belt during the drying process. This can lead to image defects resulting from the differences in temperature and the material properties of the belt and the holes in the belt. These differences in temperature can lead to changes in the rate of drying which can impact the image quality.

BRIEF SUMMARY

The following summary is provided to facilitate an understanding of some of the innovative features unique to the disclosed embodiments and is not intended to be a full description. A full appreciation of the various aspects of the embodiments disclosed herein can be gained by taking the entire specification, claims, drawings, and abstract as a whole.

It is, therefore, one aspect of the disclosed embodiments to provide for a printing system that includes a vacuum roller system for use in transporting sheets of media through and passed a dryer.

It is another aspect of the disclosed embodiments to provide for a vacuum roller system that includes an assembly of interdigitated rollers.

The aforementioned aspects and other objectives and advantages can now be achieved as described herein.

In an embodiment, a vacuum roller system can include an assembly of interdigitated rollers, and a vacuum system, wherein the assembly of interdigitated rollers is operably connected to the vacuum system to move sheets of media through a downstream dryer in a printer, wherein a vacuum is drawn between individual rollers among the assembly of interdigitated rollers so that the vacuum is distributed across a sheet of media and is split or divided around the individual rollers.

In an embodiment of the system, the spacing between the individual rollers among the assembly of interdigitated rollers is variable to vary the vacuum.

In an embodiment of the system, the vacuum system can be operable to change the vacuum drawn between the individual rollers among the assembly of interdigitated rollers.

In an embodiment of the system, the interdigitated rollers can create a roller surface comprising inter-roller gaps that reduce the spacing among the interdigitated rollers to facilitate a roller-to-roller transition with respect to each sheet of media among the sheets of media.

In an embodiment of the system, a plenum can cover a bottom of the assembly of interdigitated rollers and is drawn between each individual roll among the individual rollers, wherein a distribution vacuum thereof spreads pressure over the sheet of media in an even manner.

In an embodiment of the system, a single drive system can drive the assembly of interdigitated rollers.

In an embodiment of the system, the single drive system can include a timing belt that rotates the interdigitated rollers.

In an embodiment of the system, the single drive system comprises at least one of: a plurality of gears or an o-ring drive.

In an embodiment, a vacuum roller system, can include an assembly of interdigitated rollers; a single drive system that drives the assembly of interdigitated rollers, the single drive system comprising at least one of: a plurality of gears, a timing belt or an o-ring drive; a vacuum system, wherein the assembly of interdigitated rollers is operably connected to the vacuum system to move sheets of media through a downstream dryer in a printer, wherein a vacuum is drawn between individual rollers among the assembly of interdigitated rollers so that the vacuum is distributed across a sheet of media and is split or divided around the individual rollers; and a plenum that covers a bottom of the assembly of interdigitated rollers and is drawn between each individual roll among the individual rollers, wherein a distribution vacuum thereof spreads pressure over the sheet of media in an even manner.

In an embodiment, a method of operating a vacuum roller system, can involve creating a vacuum with a vacuum system; and moving sheets of media through a downstream dryer in a printer, wherein the vacuum is drawn between individual rollers among an assembly of interdigitated rollers so that the vacuum provided by the vacuum system is distributed across a sheet of media and is split or divided around the individual rollers.

An embodiment of the method can further involve adjusting or varying the spacing between the individual rollers among the assembly of interdigitated rollers to vary the vacuum.

In an embodiment of the method, the vacuum system can be operable to change the vacuum drawn between the individual rollers among the assembly of interdigitated rollers.

An embodiment of the method can further involve creating a roller surface via the assembly of interdigitated rollers, the roller surface comprising inter-roller gaps that reduce the spacing among the interdigitated rollers to facilitate a roller-to-roller transition with respect to each sheet of media among the sheets of media.

An embodiment of the method can further involve creating a distribution vacuum that spreads pressure over the sheets of media in an even manner, wherein the distribution vacuum is facilitated by a plenum that covers a bottom of the assembly of interdigitated rollers.

An embodiment of the method can further involve driving the assembly of interdigitated rollers with a single drive system.

In an embodiment of the method, the single drive system can comprise a timing belt that rotates the interdigitated rollers.

In an embodiment of the method, the single drive system can comprise at least one of: a plurality of gears or an o-ring drive.

BRIEF DESCRIPTION OF THE DRAWINGS

The accompanying figures, in which like reference numerals refer to identical or functionally-similar elements throughout the separate views and which are incorporated in and form a part of the specification, further illustrate the present invention and, together with the detailed description of the invention, serve to explain the principles of the present invention.

DETAILED DESCRIPTION

Figure 1:
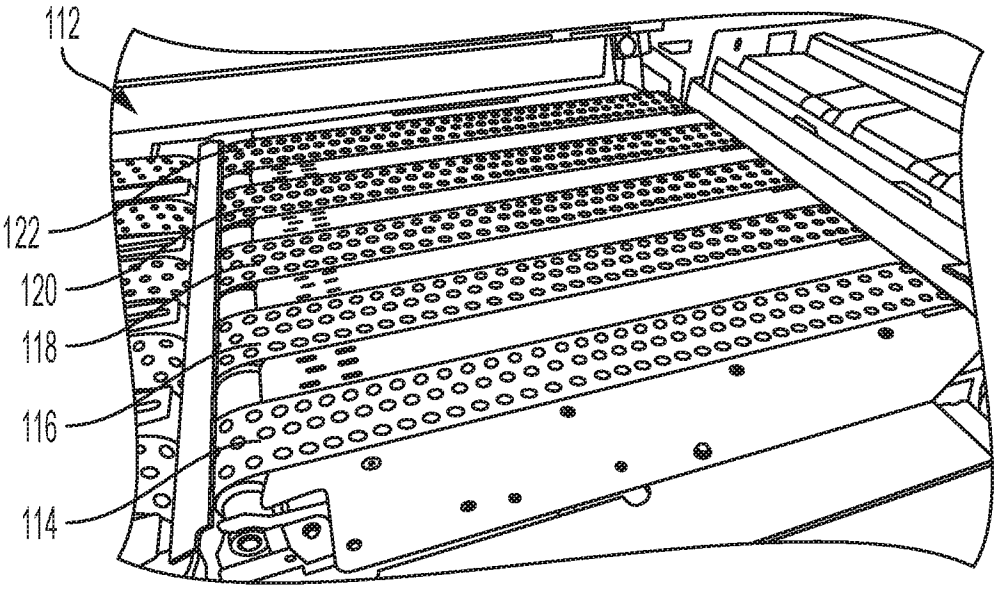
FIG. 1 PRIOR ART
FIG. 1 illustrates an image of a prior art vacuum belt transport system utilized in some printing systems.
Figure 2:
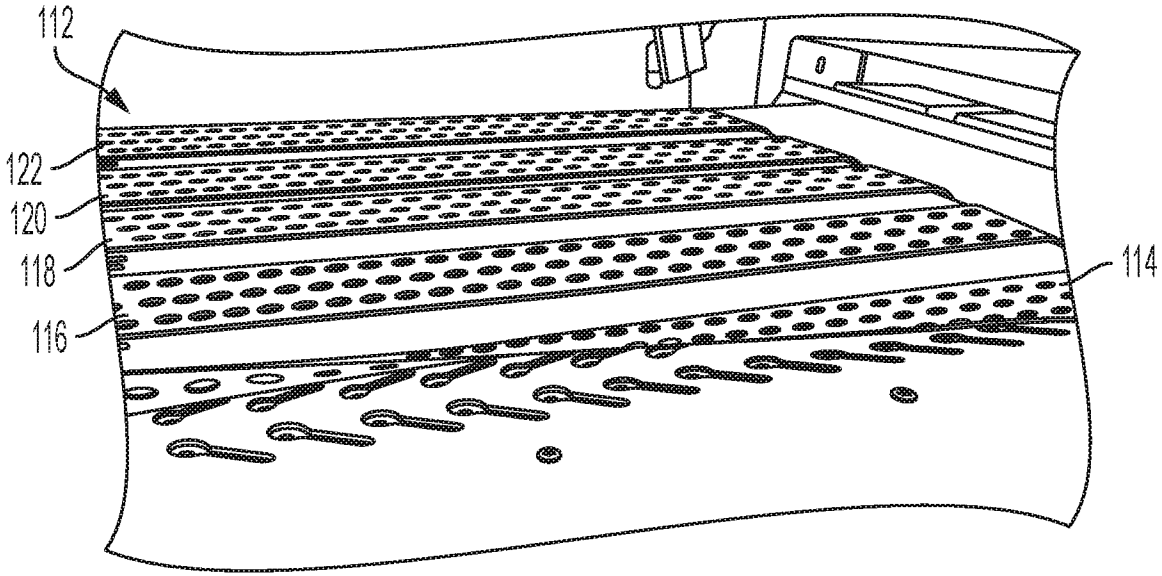
FIG. 2 PRIOR ART
FIG. 2 illustrates an image depicting a close-up view of a prior art holes/plenum configuration utilized in some printing systems.
Figure 3:
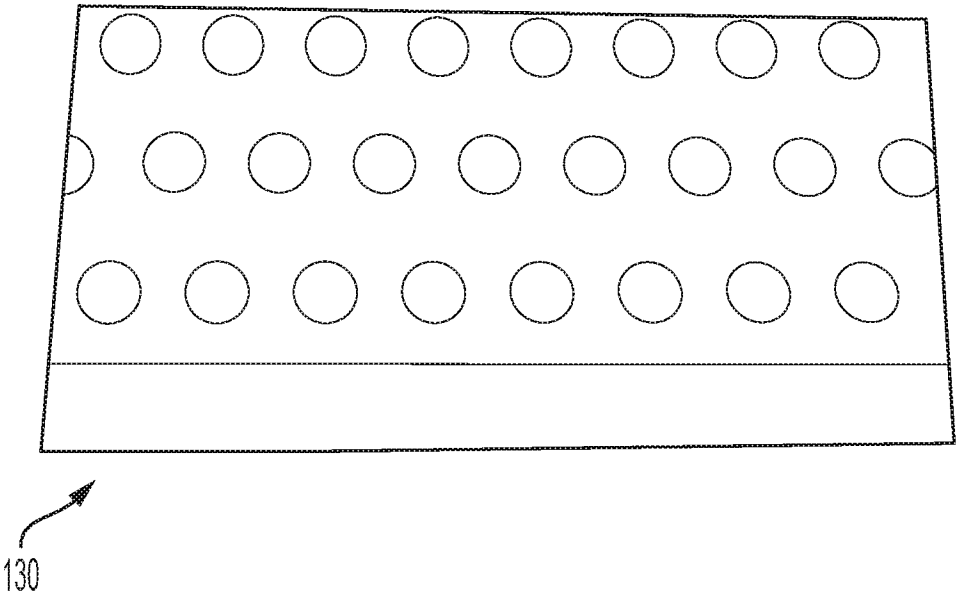
FIG. 3 PRIOR ART
FIG. 3 illustrates an image depicting a vacuum hole defect caused by prolonged contact of media to a transport belt during drying in some printing systems.

The particular values and configurations discussed in these non-limiting examples can be varied and are cited merely to illustrate one or more embodiments and are not intended to limit the scope thereof.

Subject matter will now be described more fully herein after with reference to the accompanying drawings, which form a part hereof, and which show, by way of illustration, specific example embodiments. Subject matter may, however, be embodied in a variety of different forms and, therefore, covered or claimed subject matter is intended to be construed as not being limited to any example embodiments set forth herein; example embodiments are provided merely to be illustrative. Likewise, a reasonably broad scope for claimed or covered subject matter is intended. Among other things, for example, subject matter may be embodied as methods, devices, components, or systems/devices. Accordingly, embodiments may, for example, take the form of hardware, software, firmware or any combination thereof (other than software per se). The following detailed description is, therefore, not intended to be interpreted in a limiting sense.

Throughout the specification and claims, terms may have nuanced meanings suggested or implied in context beyond an explicitly stated meaning. Likewise, phrases such as "in one embodiment" or "in an example embodiment" and variations thereof as utilized herein do not necessarily refer to the same embodiment and the phrase "in another embodiment" or "in another example embodiment" and variations thereof as utilized herein may or may not necessarily refer to a different embodiment. It is intended, for example, that claimed subject matter include combinations of example embodiments in whole or in part.

In general, terminology may be understood, at least in part, from usage in context. For example, terms, such as "and", "or", or "and/or" as used herein may include a variety of meanings that may depend, at least in part, upon the context in which such terms are used. Typically, "or" if used to associate a list, such as A, B, or C, is intended to mean A, B, and C, here used in the inclusive sense, as well as A, B, or C, here used in the exclusive sense. In addition, the term "one or more" as used herein, depending at least in part upon context, may be used to describe any feature, structure, or characteristic in a singular sense or may be used to describe combinations of features, structures, or characteristics in a plural sense. Similarly, terms such as "a", "an", or "the", again, may be understood to convey a singular usage or to convey a plural usage, depending at least in part upon context. In addition, the term "based on" may be understood as not necessarily intended to convey an exclusive set of factors and may, instead, allow for existence of additional factors not necessarily expressly described, again, depending at least in part on context. Additionally, the term "step" can be utilized interchangeably with "instruction" or "operation".

Unless defined otherwise, all technical and scientific terms used herein have the same meanings as commonly understood by one of ordinary skill in the art. As used in this document, the term "comprising" means "including, but not limited to."

Figure 13:
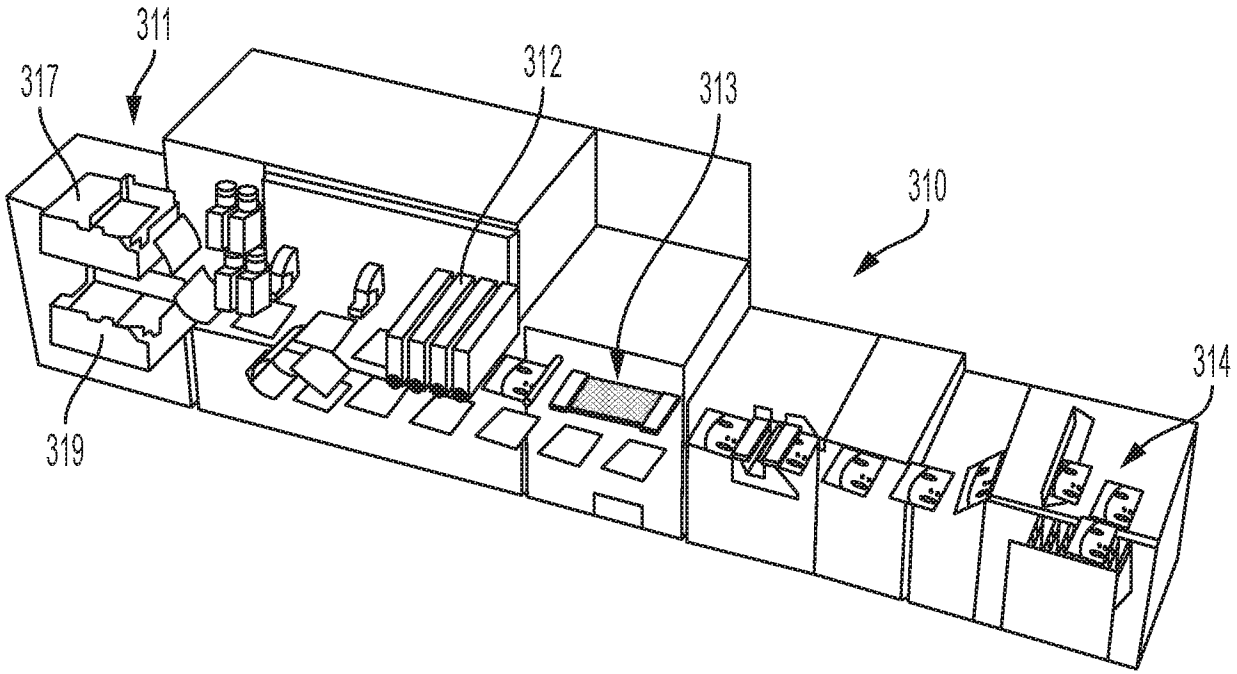
FIG. 13 illustrates a pictorial diagram depicting a printing system in which an embodiment may be implemented.

The term "printing system" as utilized herein can relate to a printer, including digital printing devices and systems that accept text and graphic output from a computing device, electronic device or data processing system and transfers the information to a substrate such as paper, usually to standard size sheets of paper. A printing system may vary in size, speed, sophistication, and cost. In general, more expensive printers are used for higher-resolution printing. A printing system can render images on print media, such as paper or other substrates, and can be a copier, laser printer, bookmaking machine, facsimile, or a multifunction machine (which can include one or more functions such as scanning, printing, archiving, emailing, faxing and so on). An example of a printing system that can be adapted for use with one or more embodiments is shown in FIG. 13 and also in FIG. 16.

The term "transport belt" as utilized herein can relate to a belt implemented in a printing system in association in with a rotatable member such as a roller or other transport members or web transport configurations. Such a transport belt can relate to marking transport or marker transport, which may become contaminated with aqueous ink. To permit a high registration accuracy, a printing system can employ such a transport belt, which in some implementations can pass in front of toner cartridges and each of the toner layers can be precisely applied to the transport belt. The combined layers can be then applied to the paper in a uniform single step. It should be appreciated, however, that the disclosed embodiments are not limited to printers that utilize toner. Ink and other types of marking media may be utilized in other printing embodiments. That is, a printing system is not limited to a laser printing implementation but may be realized in other contexts, such as ink-jet printing systems.

A "computing device" or "electronic device" or "data processing system" refers to a device or system that includes a processor and non-transitory, computer-readable memory. The memory may contain programming instructions that, when executed by the processor, cause the computing device to perform one or more operations according to the programming instructions. As used in this description, a "computing device" or "electronic device" may be a single device, or any number of devices having one or more processors that communicate with each other and share data and/or instructions. Examples of computing devices or electronic devices include, without limitation, personal computers, servers, mainframes, gaming systems, televisions, and portable electronic devices such as smartphones, personal digital assistants, cameras, tablet computers, laptop computers, media players and the like. Various elements of an example of a computing device or processor are described below in reference to FIGS. 14 and 15.

Figure 4:
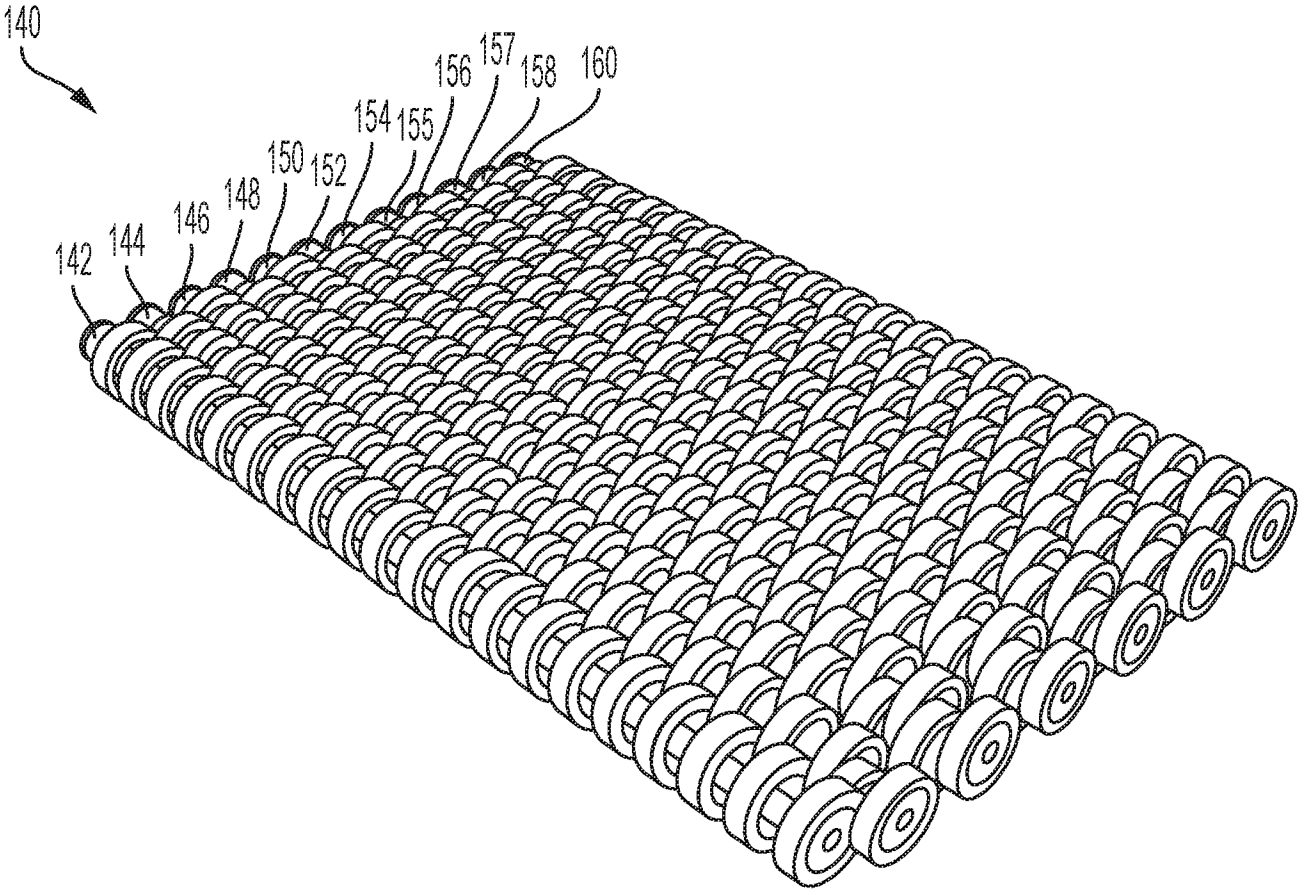
FIG. 4 illustrates a pictorial diagram depicting an operator side interdigitated roller vacuum assembly, in accordance with an embodiment.
Figure 16:
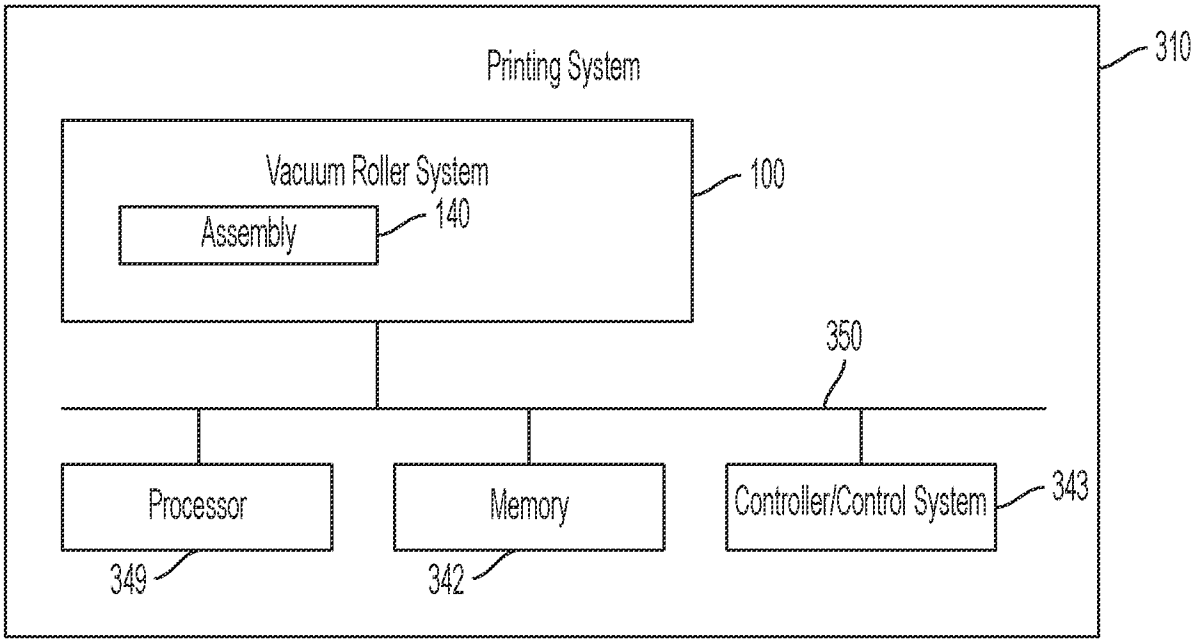
FIG. 16 illustrates a block diagram depicting a printing system which can include a vacuum roller system, in accordance with an embodiment.

FIG. 4 illustrates a pictorial diagram depicting an operator side interdigitated roller vacuum assembly 140 of interdigitated rollers, in accordance with an embodiment. As shown in FIG. 4, the interdigitated roller vacuum assembly 140 of interdigitated rollers can include a group of timing pulleys composed of a timing pulley 142, a timing pulley 144, a timing pulley 146, a timing pulley 148, a timing pulley 150, a timing pulley 152, a timing pulley 154, a timing pulley 156, a timing pulley 158, and a timing pulley 160. Each of the aforementioned timing pulleys turn a respective drive shaft and engage respectively with a group of rollers in an interdigitated pattern of rollers. The interdigitated roller vacuum assembly 140 can be implemented in the context of a vacuum roller system 100, which is shown in FIG. 16. Note that the term interdigitated as utilized herein relates to something that has become interlocked like the fingers of folded or clasped hands, or interweaved like the joined fingers of two hands.

Figure 5:
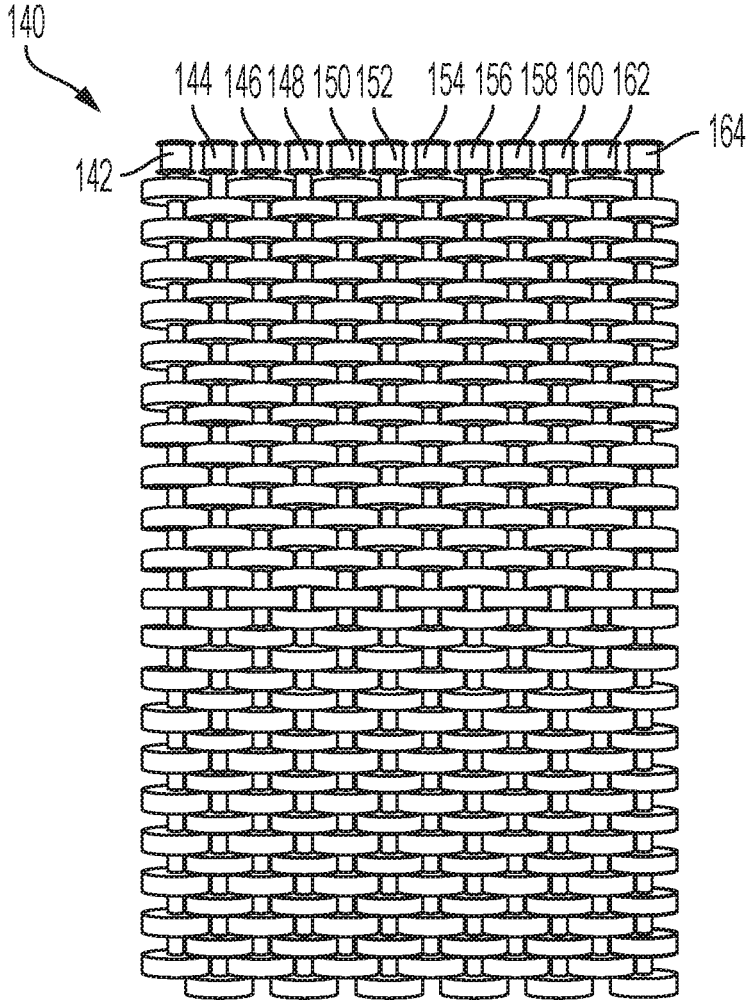
FIG. 5 illustrates a pictorial diagram depicting the top view of an interdigitated pattern of rollers of an interdigitated roller vacuum assembly, in accordance with an embodiment.

FIG. 5 illustrates a pictorial diagram depicting the top view of an interdigitated pattern of rollers of the interdigitated roller vacuum assembly 140, in accordance with an embodiment. Note that in FIGS. 5-12, identical or similar parts or elements are generally indicated by identical reference numerals. Thus, in the top view depicted in FIG. 5, the group of timing pulleys is also shown include the timing pulley 142 to the timing pulley 160 and each circular shaped and respective roller.

Figure 6:
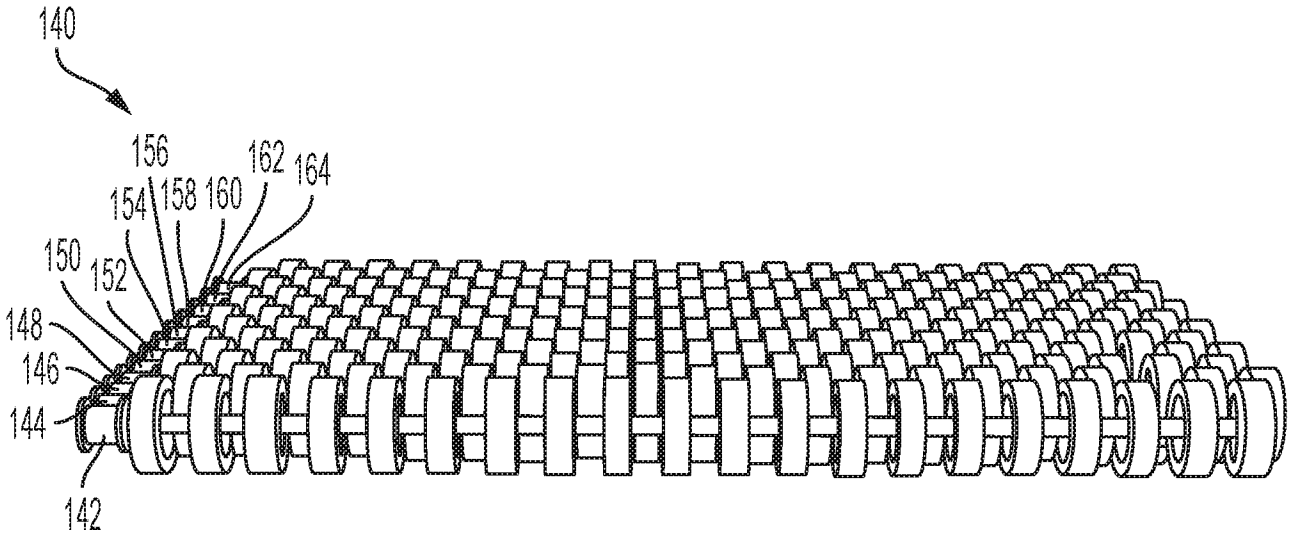
FIG. 6 illustrates a pictorial diagram depicting the front view of an interdigitated roller vacuum assembly, which can provide intermittent contact during transport of drying media, in accordance with an embodiment.

FIG. 6 illustrates a pictorial diagram depicting the front view of the interdigitated roller vacuum assembly 140, which can provide intermittent contact during transport of drying media, in accordance with an embodiment. That is, the interdigitated roller vacuum assembly 140 can be implemented as a part of a roll system that includes the aforementioned timing pulley 142 to the timing pulley 160, and the respective rollers that surround and engage with each of the timing pulley 142 to the timing pulley 160.

Figure 7:
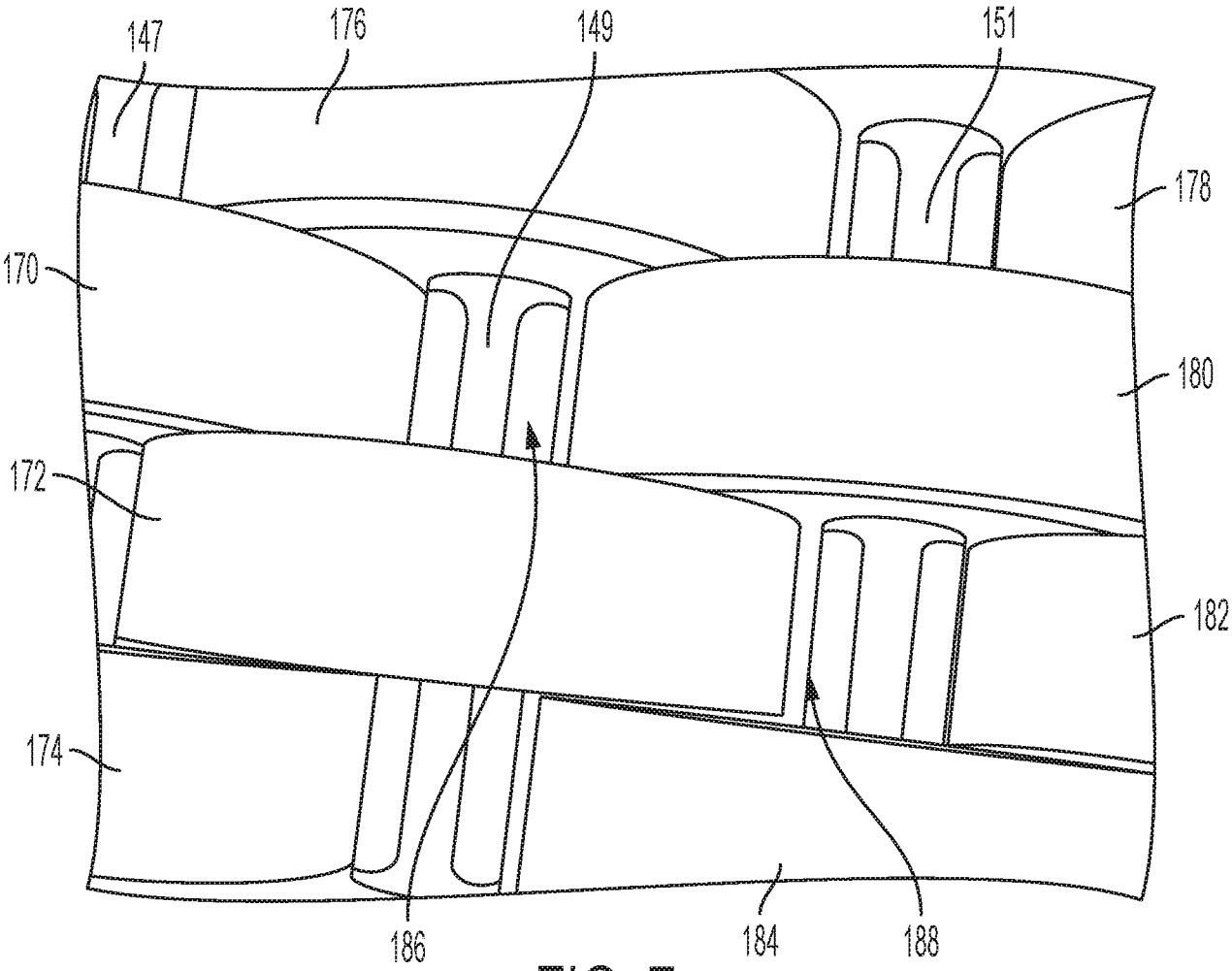
FIG. 7 illustrates a pictorial diagram depicting a top view and close-up of interdigitated rollers with drive shafts, in accordance with an embodiment.

FIG. 7 illustrates a pictorial diagram depicting a top view and close-up of interdigitated rollers with drive shafts, in accordance with an example embodiment. Note that as utilized herein, the terms "roll" and "roller" may be utilized interchangeably to refer to the same components or element. In FIG. 7, a roller 176 and a roller 182 surround a drive shaft 149. Note that the drive shaft 149 can engage with the timing pulley 148 discussed previously. Similarly, a roller 180 and a roller 184 surround and engage with a drive shaft 151, which in turn is driven by the previously discussed timing pulley 150. A roller 170 and a roller 174 similarly engage with a drive shaft 147 that in turn connects to and is driven by the previously discussed timing pulley 146 (e.g., a timing belt). Additional rollers 178 and 182 are shown in FIG. 7 as well. FIG. 7 also depicts a location 186 and a location 188, which are points where a vacuum is drawn around respectively, the shaft 149 and the shaft 151 and between rollers to provide a distributed vacuum pressure.

Figure 8:
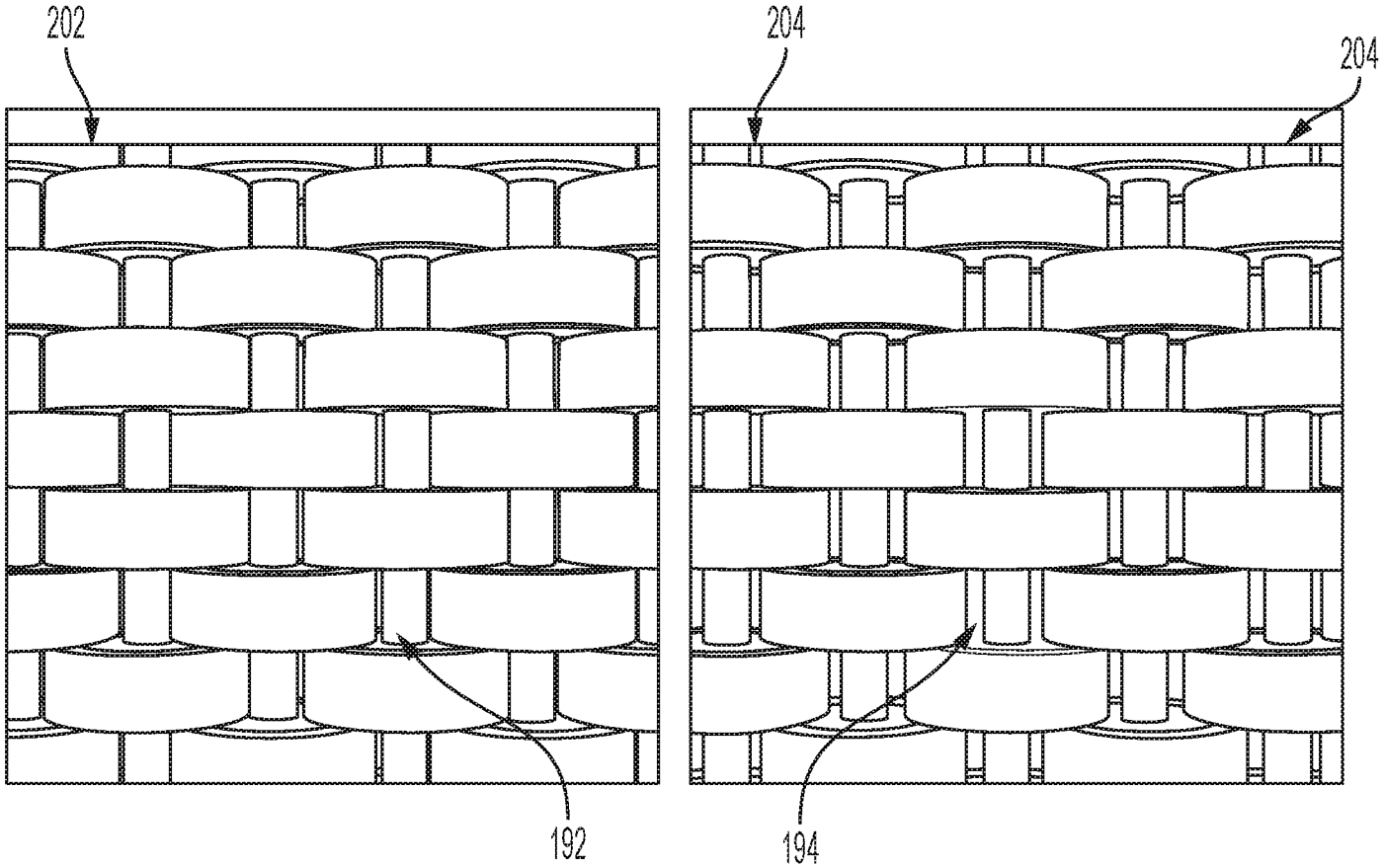
FIG. 8 illustrates a pictorial diagram depicting a drive view (close-up) of a vacuum roller system showing variable shaft spacing, in accordance with an embodiment.

FIG. 8 illustrates a pictorial diagram depicting a drive view (close-up) of the interdigitated roller vacuum assembly 140 of the disclosed vacuum roller system showing variable shaft spacing, in accordance with an example embodiment. That is, FIG. 8 shows a view 202 and a view 204 of a portion of the interdigitated roller vacuum assembly 140. The view 202 shown in FIG. 8 depicts roller spacing minimized for lower vacuum levels and the view 204 depicted in FIG. 8 illustrates roller spacing maximized for higher vacuum levels. A location 192 and a location 194 depicted in FIG. 8 thus depict shaft/roller spacing adjusted to allow optimized vacuum to be drawn around the shaft and between the rollers to provide a distributed vacuum pressure. Note that the spacing of the rolls can be varied to vary the vacuum. In addition, the vacuum can be changed through the disclosed vacuum system itself. Either can be then related to media weight and/or size.

Figure 9:
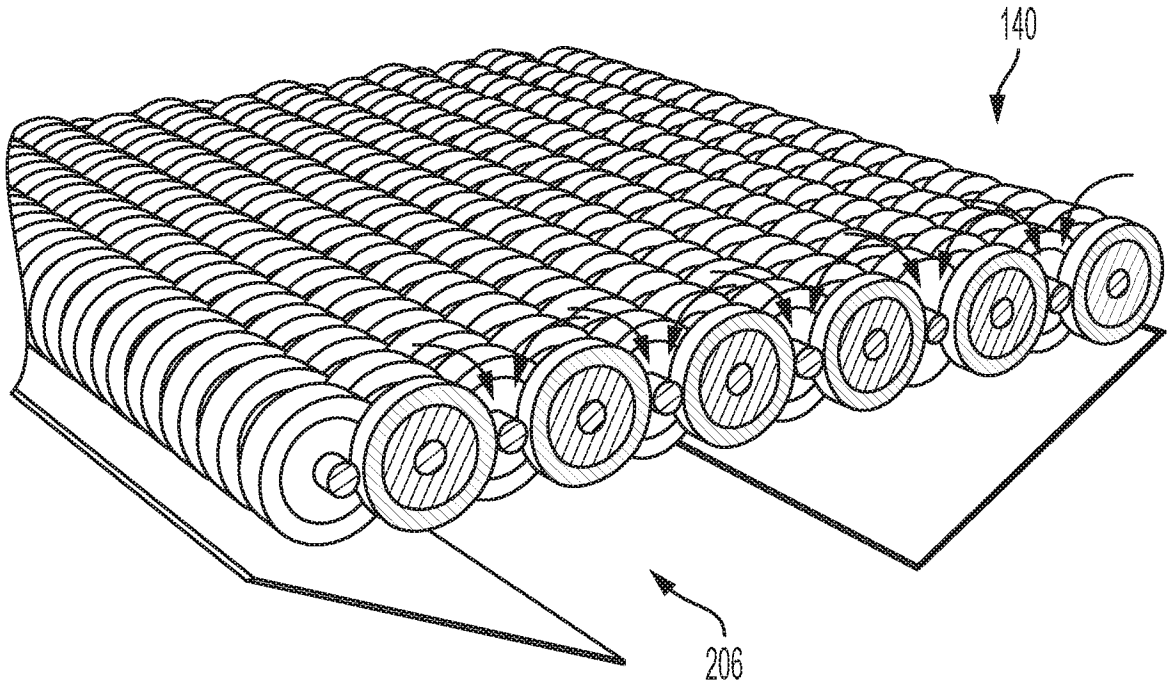
FIG. 9 illustrates a pictorial diagram depicting a sectional view of a vacuum roller system with the lower plenum shown, in accordance with an embodiment.

FIG. 9 illustrates a pictorial diagram depicting a sectional view of a roll system including the interdigitated roller vacuum assembly 140 of interdigitated rollers with a lower plenum 206 shown, in accordance with an example embodiment. The lower plenum 206 may from part of an overall plenum such as the plenum 210 shown in FIGS. 10-12. That is, a vacuum plenum can be configured below the interdigitated roller vacuum assembly 140 and hence, the roll system, to pull even vacuum across a media surface. The vacuum is designated in FIG. 9 with circular arrows indicating that the vacuum is drawn between the rolls (or rollers). Note that the term "plenum" as utilized herein can relate to a pressurized housing or chamber containing a gas or fluid (typically air) at positive pressure. One function of a plenum can be to equalize pressure for more even distribution, because of irregular supply or demand.

The interdigitated roller vacuum assembly 140 can be configured in the context of an interdigitated roll system that can be integrated into a printing system (e.g., a cut sheet ink jet printer dryer) to reduce or eliminate drying artifacts caused by the constant belt surface to media contact during drying. Such an interdigitated roll system can include interdigitated high temperature rolls integrated with a distributed vacuum system to provide uniform vacuum hold down to a driven piece of cut sheet media through a dryer. Such an interdigitated roll system can include an adjustable roll system and a drive system that allows for differences in the application of vacuum to the media. This can allow for the adjustment of drive roll spacing to optimize vacuum application and balance vacuum and drive. The drive system may be implemented with different types of drive systems that can include or involve adjusting or varying components such as gears or o-ring drives, etc.

A control system 343 (also shown as 'controller/control system 343 in FIG. 16) can be linked to the interdigitated roller vacuum assembly 140 to adjust roll spacing and vacuum pressure/application based on media parameters input to the interdigitated roll system. The interdigitated roll system may use a series of closely spaced rolls that reduce roll-to-roll handoff distances, limits non-relative motion contact between the conveyance system and the media, and provides a consistent transport surface to reduce counter-productive media stubs, jams and other media issues associated with roll-to-roll transports.

Figure 10:
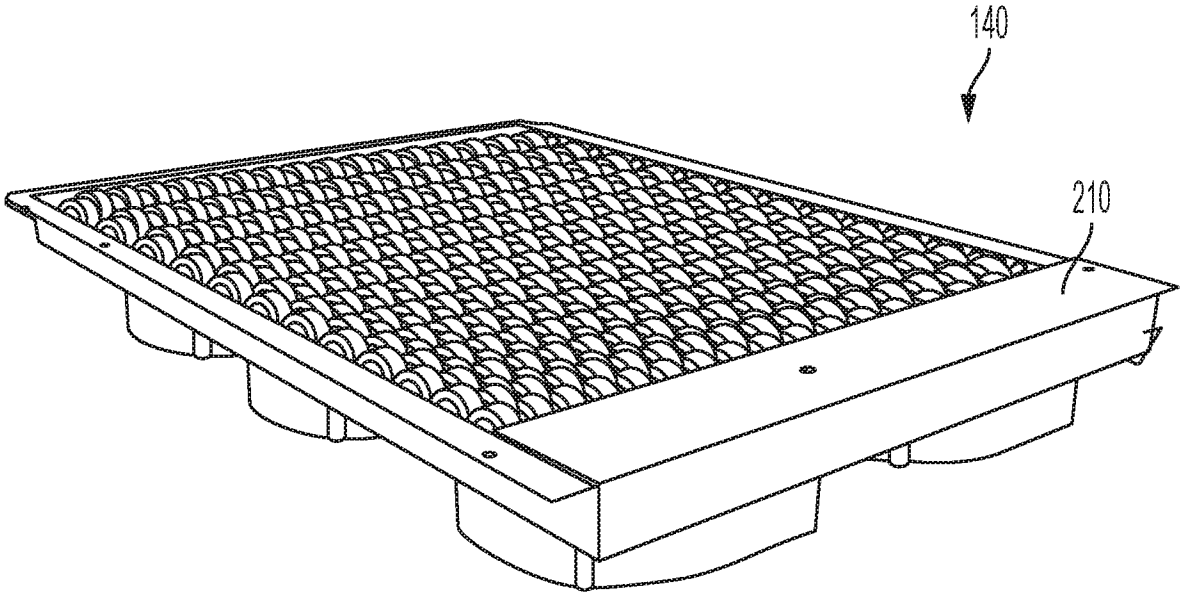
FIG. 10 illustrates a pictorial diagram depicting a perspective view of a vacuum roller system, in accordance with an embodiment.
Figure 11:
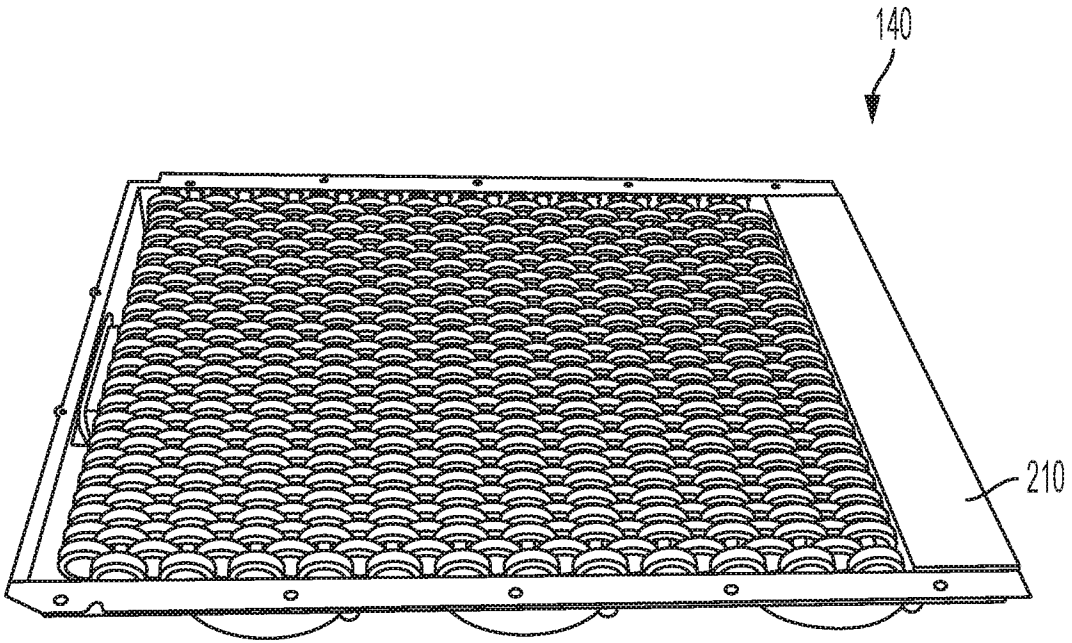
FIG. 11 illustrates a pictorial diagram depicting a perspective side view of a vacuum roller system, in accordance with an embodiment.
Figure 12:
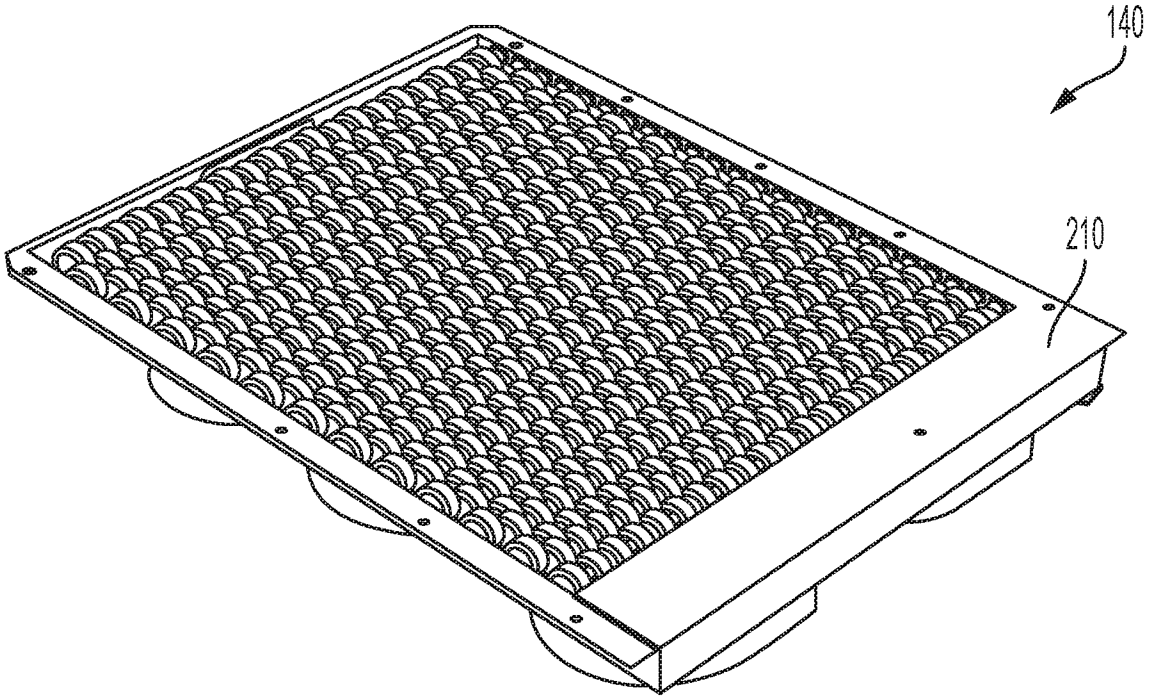
FIG. 12 illustrates a pictorial diagram depicting another perspective view of a vacuum roller system, in accordance with an embodiment.

FIG. 10 illustrates a pictorial diagram depicting a perspective view of a vacuum roller system including the interdigitated roller vacuum assembly 140 and the plenum 210, in accordance with an embodiment. FIG. 11 illustrates a pictorial diagram depicting a perspective side view of a vacuum roller system including the interdigitated roller vacuum assembly 140, in accordance with an embodiment. FIG. 12 illustrates a pictorial diagram depicting another perspective view of a vacuum roller system including the interdigitated roller vacuum assembly 140, in accordance with an embodiment.

The interdigitated roller vacuum assembly 140 can be implemented as a part of a drive system that continually moves sheets of media through a dryer (e.g., a radiant dryer) in a printing system at a constant velocity while only contacting the sheet(s) intermittently in both the cross process and process directions, limiting the time the sheet of media is in contact with any particular part of the drive system. The system also makes use of vacuum, but the vacuum may be applied across the sheet bottom surface at continually different locations as the sheet of media is in contact with each roller.

The aforementioned vacuum can be applied through the rollers and across the system of rollers (e.g., the interdigitated roller vacuum assembly 140) as the sheet of media moves across the top of the rollers only contacting the tops of the rollers intermittently to provide drive. This is important because using a full width roller system that applies vacuum between the rollers can lead to lighter weight media or media with down curl being driven into a downstream roller. When the rollers possess a lower durometer silicone drive surface, this can lead to stubbing if the sheets are directed at too steep an angle into a downstream roller. Thus, by overlapping the rolls in an interdigitated pattern as shown in FIGS. 1-12 herein, the distance from top of roll to top of roll can be dramatically reduced A benefit of this approach is the ability to transport a sheet of media without having continual contact between a belt/belt hole surface and the back of the media. The distance between the roll shafts can be optimized to allow for the required vacuum to interact with the sheet of media.

The drive system including the interdigitated roller vacuum assembly 140 can be configured to be driven with a drive system using an adjustable timing belt (e.g., a 10 mm timing belt) design, which can allow for the option of having the roller spacing varied on a media to media basis or to facilitate optimizing the vacuum delivered to the media surface. The belt length difference can be taken up by an adjustable idler via a cam or actuator and this adjustment can allow for performance of the media to be optimized based on particular media characteristics (e.g., size, weight, coating, curl, etc). In addition, different types of drive systems may be implemented in accordance with different embodiments. For example, some drive systems may include a group of gears as a part of the driver system. Other drive systems may incorporate the use of o-ring drives.

FIG. 13 illustrates a pictorial diagram depicting an example printing system 310 in which an embodiment may be implemented. In some embodiments, the printing system 310 can be implemented as an aqueous inkjet printer. The printing system 310 shown in FIG. 13 can include a number of sections or modules, such as, for example, a sheet feed module 311, a print head and ink assembly module 312, a dryer module 313 and a production stacker 314. The sheet feed module 311 can include a module 317 that maintains or stores sheets or media. The sheet feed module 311 can also include another module 319 that can also maintain or store sheets of media. Such modules can be composed of physical hardware components, but in some cases may include the use of software or may be subject to software instructions.

It should be appreciated that the printing system 310 depicted in FIG. 13 represents one example of an aqueous inkjet printer that can be adapted for use with one or more embodiments. The particular configuration and features shown in FIG. 13 should not be considered limiting features of the disclosed embodiments. That is, other types of printers can be implemented in accordance with different embodiments. For example, the printing system 310 can be configured as a printer that uses water-based inks or solvent-based inks, or in some cases may utilize toner ink in the context of a LaserJet printing embodiment.

In an embodiment, the sheet feed module 311 of the printing system 310 can be configured to hold, for example, 2,500 sheets of 90 gsm, 4.0 caliper stock in each of two trays. With 5,000 sheets per unit and up to 4 possible feeders in such a configuration, 20,000 sheets of non-stop production activity can be facilitated by the printing system 310. The sheet feed module can include an upper tray 17 that holds, for example, paper sizes 8.27"×10"/210 mm×254 mm to 14.33"×20.5"/364 mm×521 mm, while a lower tray 19 can hold paper sizes ranging from, for example, 7"×10"/178 mm×254 mm to 14.33"×20.5"/364 mm×521 mm. Each feeder can utilize a shuttle vacuum feed head to pick a sheet of media off the top of the stack and deliver it to a transport mechanism.

In an embodiment, the print head and ink assembly module 312 of the printing system 310 can include a plurality of inkjet print heads that can be configured to deliver four different drop sizes through, for example, 7,870 nozzles per color to produce prints with, for example, a 600×600 dpi. An integrated full-width scanner can enable automated print head adjustments, missing jet correction and image-on-paper registration. Operators can make image quality improvements for special jobs such as edge enhancement, trapping, and black overprint. At all times automated checks and preventative measures can maintain the press in a ready state and operational.

The dryer module 313 of the printing system 310 can include a dryer. After printing, the sheets of media can move directly into a dryer where the paper and ink are heated with seven infrared carbon lamps to about 90° C. (194° F.). This process can remove moisture from the paper so that the sheets of media are sufficiently stiff to move efficiently through the paper path. The drying process can also remove moisture from the ink to prevent it from rubbing off. A combination of sensors, thermostats, thermistors, thermopiles, and blowers can accurately heat these fast-moving sheets of media, and can maintain a rated print speed.

The production stacker 314 can include a finisher that can run continuously as it delivers up to, for example, 2,850 sheets of media at a time. Once unloaded, the stack tray can return to the main stack cavity to pick and deliver another load—continuously. The stacker 114 can provide an adjustable waist-height for unloading from, for example, 8" to 24", and a by-pass path with the ability to rotate sheets to downstream devices. The production stacker 14 can also be configured with, for example, a 250-sheet top tray for sheet purge and samples, and can further include an optional production media cart to ease stack transport. One non-limiting example of printing system 310 is the Xerox® Brenva® HD Production Inkjet Press, a printing product of Xerox Corporation. The printing system can include transport members including the transport belts discussed herein and/or other features including for example a Brenva®/Fervent® marking transport, which is also a product of Xerox Corporation.

As can be appreciated by one skilled in the art, embodiments can be implemented in the context of a method, data processing system, or computer program product. Accordingly, embodiments may take the form of an entirely hardware embodiment, an entirely software embodiment or an embodiment combining software and hardware aspects all generally referred to herein as a "circuit" or "module." Furthermore, embodiments may in some cases take the form of a computer program product on a computer-usable storage medium having computer-usable program code embodied in the medium. Any suitable computer readable medium may be utilized including hard disks, USB Flash Drives, DVDs, CD-ROMs, optical storage devices, magnetic storage devices, server storage, databases, etc.

Computer program code for carrying out operations of the present invention may be written in an object oriented programming language (e.g., Java, C++, etc.). The computer program code, however, for carrying out operations of particular embodiments may also be written in procedural programming languages or in a visually oriented programming environment.

The program code may execute entirely on a user's computer, partly on a user's computer, as a stand-alone software package, partly on a user's computer and partly on a remote computer or entirely on the remote computer. In the latter scenario, the remote computer may be connected to a user's computer through a bidirectional data communications network (e.g., a local area network (LAN), wide area network (WAN), wireless data network, a cellular network, etc.) or the bidirectional connection may be made to an external computer via most third party supported networks (e.g., through the Internet utilizing an Internet Service Provider).

The embodiments are described at least in part herein with reference to flowchart illustrations and/or block diagrams of methods, systems, and computer program products and data structures according to embodiments of the invention. It will be understood that each block of the illustrations, and combinations of blocks, can be implemented by computer program instructions. These computer program instructions may be provided to a processor of, for example, a general-purpose computer, special-purpose computer, or other programmable data processing apparatus to produce a machine, such that the instructions, which execute via the processor of the computer or other programmable data processing apparatus, create means for implementing the functions/acts specified in the block or blocks. To be clear, the disclosed embodiments can be implemented in the context of, for example a special-purpose computer or a general-purpose computer, or other programmable data processing apparatus or system. For example, in some embodiments, a data processing apparatus or system can be implemented as a combination of a special-purpose computer and a general-purpose computer.

These computer program instructions may also be stored in a computer-readable memory that can direct a computer or other programmable data processing apparatus to function in a particular manner, such that the instructions stored in the computer-readable memory produce an article of manufacture including instruction means which implement the function/act specified in the various block or blocks, flowcharts, and other architecture illustrated and described herein.

The computer program instructions may also be loaded onto a computer or other programmable data processing apparatus to cause a series of operational steps to be performed on the computer or other programmable apparatus to produce a computer implemented process such that the instructions which execute on the computer or other programmable apparatus provide steps for implementing the functions/acts specified in the block or blocks.

The flowchart and block diagrams in the figures illustrate the architecture, functionality, and operation of possible implementations of systems, methods, and computer program products according to various embodiments of the present invention. In this regard, each block in the flowchart or block diagrams may represent a module, segment, or portion of instructions, which comprises one or more executable instructions for implementing the specified logical function(s). In some alternative implementations, the functions noted in the block may occur out of the order noted in the figures. For example, two blocks shown in succession may, in fact, be executed substantially concurrently, or the blocks may sometimes be executed in the reverse order, depending upon the functionality involved. It will also be noted that each block of the block diagrams and/or flowchart illustration, and combinations of blocks in the block diagrams and/or flowchart illustration, can be implemented by special purpose hardware-based systems that perform the specified functions or acts or carry out combinations of special purpose hardware and computer instructions.

Figure 14:
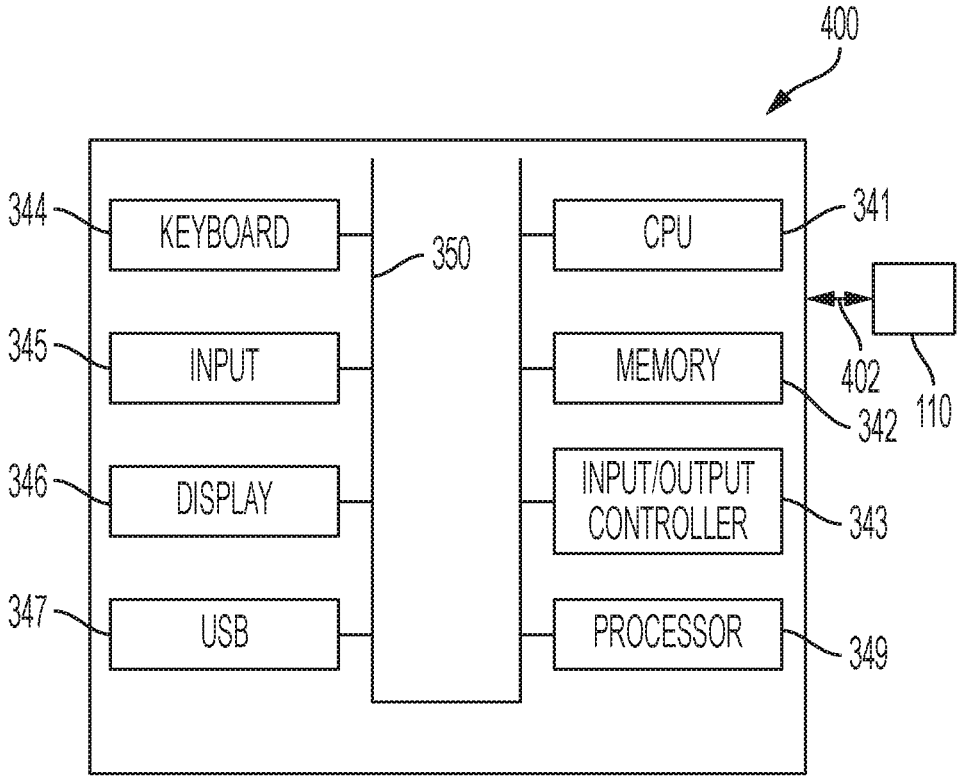
FIG. 14 illustrates a schematic view of a computer system, in accordance with an embodiment.
Figure 15:
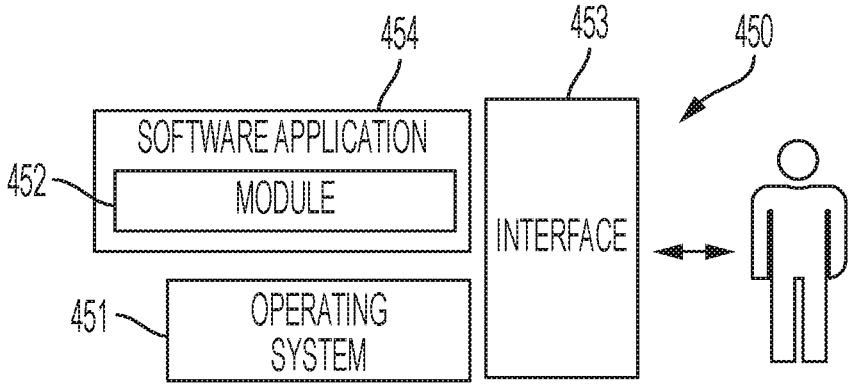
FIG. 15 illustrates a schematic view of a software system including a module, an operating system, and a user interface, in accordance with an embodiment.

FIGS. 14-15 are shown only as exemplary diagrams of data-processing environments in which example embodiments may be implemented. It should be appreciated that FIGS. 14-15 are only exemplary and are not intended to assert or imply any limitation with regard to the environments in which aspects or embodiments may be implemented. Many modifications to the depicted environments may be made without departing from the spirit and scope of the disclosed embodiments.

As illustrated in FIG. 14, some embodiments may be implemented in the context of a data-processing system 400 that can include, for example, one or more processors including a CPU (Central Processing Unit) 341 and/or other another processor 349 (e.g., microprocessor, microcontroller etc), a memory 342, an input/output controller 343, a peripheral USB (Universal Serial Bus) connection 347, a keyboard 344 and/or another input device 345 (e.g., a pointing device such as a mouse, trackball, pen device, etc.), a display 346 (e.g., a monitor, touch screen display, etc) and/or other peripheral connections and components. FIG. 14 is an example of a computing device that can be adapted for use in accordance with one possible embodiment.

As illustrated, the various components of data-processing system 400 can communicate electronically through a system bus 351 or similar architecture. The system bus 351 may be, for example, a subsystem that transfers data between, for example, computer components within data-processing system 400 or to and from other data-processing devices, components, computers, etc. The data-processing system 400 may be implemented in some embodiments as, for example, a server in a client-server based network (e.g., the Internet) or in the context of a client and a server (i.e., where aspects are practiced on the client and the server).

In some example embodiments, data-processing system 400 may be, for example, a standalone desktop computer, a laptop computer, a Smartphone, a pad computing device, a networked computer server, and so on, wherein each such device can be operably connected to and/or in communication with a client-server based network or other types of networks (e.g., cellular networks, Wi-Fi, etc). The data-processing system 400 can communicate with other devices or systems (e.g., the printing system 310). Communication between the data-processing system 400 and the printing system 310 can be bidirectional, as indicated by the double arrow 402. Such bidirectional communications may be facilitated by, for example, a computer network, including wireless bidirectional data communications networks.

FIG. 15 illustrates a computer software system 450 for directing the operation of the data-processing system 400 depicted in FIG. 14. Software application 454, stored for example in the memory 342 can generally include one or more modules, an example of which is module 452. The computer software system 450 also can include a kernel or operating system 451 and a shell or interface 453. One or more application programs, such as software application 454, may be "loaded" (i.e., transferred from, for example, mass storage or another memory location into the memory 342) for execution by the data-processing system 400. The data-processing system 400 can receive user commands and data through the interface 453; these inputs may then be acted upon by the data-processing system 400 in accordance with instructions from operating system 451 and/or software application 454. The interface 453 in some embodiments can serve to display results, whereupon a user 459 may supply additional inputs or can terminate a session. The software application 454 can include module(s) 452, which can, for example, implement instructions or operations such as those discussed herein. Module 452 may also be composed of a group of modules and/or sub-modules.

The following discussion is intended to provide a brief, general description of suitable computing environments in which the system and method may be implemented. Although not required, the disclosed embodiments will be described in the general context of computer-executable instructions, such as program modules, being executed by a single computer. In most instances, a "module" can constitute a software application, but can also be implemented as both software and hardware (i.e., a combination of software and hardware).

Generally, program modules include, but are not limited to, routines, subroutines, software applications, programs, objects, components, data structures, etc., that perform particular tasks or implement particular data types and instructions. Moreover, those skilled in the art will appreciate that the disclosed method and system may be practiced with other computer system configurations, such as, for example, hand-held devices, multi-processor systems, data networks, microprocessor-based or programmable consumer electronics, networked PCs, minicomputers, mainframe computers, servers, and the like.

Note that the term module as utilized herein may refer to a collection of routines and data structures that perform a particular task or implements a particular data type. A module may be composed of two parts: an interface, which lists the constants, data types, variable, and routines that can be accessed by other modules or routines, and an implementation, which may be private (e.g., accessible only to that module) and which can include source code that actually implements the routines in the module. The term module can also refer to an application, such as a computer program designed to assist in the performance of a specific task, such as word processing, accounting, inventory management, etc. A module may also refer to a physical hardware component or a combination of hardware and software. The previously discussed dryer module 113 is an example of a physical hardware component that can also operate according to instructions provided by a module such as module 452.

The module 452 may include instructions (e.g., steps or operations) for performing operations such as those discussed herein. For example, module 452 may include instructions for operating a vacuum roller system such as the vacuum roller system 100 shown in FIG. 16 including the interdigitated roller vacuum assembly 140 in the context of a printing system such as the printing system 310.

FIG. 16 illustrates a block diagram depicting the printing system 310, which can include a vacuum roller system 100 that comprises the aforementioned interdigitated roller vacuum assembly 140, in accordance with an embodiment. The printing system 310 shown in FIG. 16 is an alternative embodiment of the configuration shown in FIG. 13, and may include, for example, the processor 349, the memory 342, and the controller 343, which together may operate the vacuum roller system 100 and the interdigitated roller vacuum assembly 140. Alternatively, the printing system 310 may simply communicate with a data-processing system such as the data-processing system 400 to operate the vacuum roller system 100 and the interdigitated roller vacuum assembly 140.

It will be appreciated that variations of the above-disclosed and other features and functions, or alternatives thereof, may be desirably combined into many other different systems or applications. It will also be appreciated that various presently unforeseen or unanticipated alternatives, modifications, variations or improvements therein may be subsequently made by those skilled in the art which are also intended to be encompassed by the following claims.

What is claimed is:

1. A vacuum roller system, comprising:

an assembly of interdigitated rollers comprising an interdigitated pattern of rollers comprising interlocked rollers that are clasped or interleaved, wherein the assembly of interdigitated rollers includes a plurality of shafts on which the interlocked rollers are located, wherein the plurality of shafts includes variable shaft spacing;

a vacuum system, wherein the assembly of interdigitated rollers is operably connected to the vacuum system to move sheets of media through a downstream dryer in a printer, wherein a vacuum is drawn between individual rollers among the assembly of interdigitated rollers, wherein the vacuum is distributed across a sheet of media among the sheets of media and is split around the individual rollers;

a vacuum plenum that covers a bottom of the assembly of interdigitated rollers, the vacuum plenum including a lower plenum, wherein the vacuum is drawn between each individual roll among the individual rollers, wherein a distribution of vacuum thereof spreads a vacuum pressure over the sheet of media in an even manner, wherein the vacuum plenum equalizes the vacuum pressure for the distribution of the vacuum in an even manner because of an irregular supply or an irregular demand; and a control system linked to the assembly of interdigitated rollers comprising the interdigitated pattern of rollers, wherein the control system is operable to adjust roll spacing among the rollers of the assembly of interdigitated rollers and the vacuum pressure based on media parameters input to the vacuum roller system.

2. The system of claim 1 wherein:

a spacing between the individual rollers among the assembly of interdigitated rollers is variable to vary the vacuum as a result of the variable shaft spacing; and each shaft among the plurality of shafts comprises a drive shaft that engages a respective timing pulley at an end of each respective drive shaft.

3. The system of claim 2 wherein:

the vacuum system is operable to change the vacuum drawn between the individual rollers among the assembly of interdigitated rollers; and the respective timing pulley turns the respective drive shaft and engages respectively with a group of rollers in the interdigitated pattern of rollers.

4. The system of claim 1 wherein the interdigitated rollers create a roller surface comprising inter-roller gaps that reduce a spacing among the interdigitated rollers to facilitate a roller-to-roller transition with respect to each sheet of media among the sheets of media.

5. The system of claim 1 further comprising a single drive system that drives the assembly of interdigitated rollers.

6. The system of claim 5 wherein the single drive system rotates the interdigitated rollers and allows for a roller spacing among the interdigitated rollers to be varied on a media-to-media basis or to facilitate optimizing the vacuum delivered to a surface of the media.

7. The system of claim 5 wherein the assembly of interdigitated rollers comprises a plurality of timing pulleys.

8. A vacuum roller system, comprising:

an assembly of interdigitated rollers comprising an interdigitated pattern of rollers comprising interlocked rollers that are clasped or interleaved, wherein the assembly of interdigitated rollers includes a plurality of shafts on which the interlocked rollers are located, the plurality of shafts including variable shaft spacing;

a single drive system that drives the assembly of interdigitated rollers;

a vacuum system, wherein the assembly of interdigitated rollers is operably connected to the vacuum system to move sheets of media through a downstream dryer in a printer, wherein a vacuum is drawn between individual rollers among the assembly of interdigitated rollers, wherein the vacuum is distributed across a sheet of media among the sheets of media and is split around the individual rollers among the assembly of interdigitated rollers;

a vacuum plenum that covers a bottom of the assembly of interdigitated rollers, the vacuum plenum including a lower plenum, wherein the vacuum is drawn between each individual roll among the individual rollers, wherein a distribution of vacuum thereof spreads a vacuum pressure over the sheet of media in an even manner, wherein the vacuum plenum equalizes the vacuum pressure for the distribution of the vacuum in an even manner because of an irregular supply or an irregular demand; and a control system linked to the assembly of interdigitated rollers comprising the interdigitated pattern of rollers, wherein the control system is operable to adjust roll spacing among the rollers of the assembly of interdigitated rollers and the vacuum pressure based on media parameters input to the vacuum roller system.

9. The system of claim 8 wherein:

a spacing between the individual rollers among the assembly of interdigitated rollers is variable to vary the vacuum as a result of the variable shaft spacing; and each shaft among the plurality of shafts comprises a drive shaft that engages a respective timing pulley.

10. The system of claim 9 wherein:

the vacuum system is operable to change the vacuum drawn between the individual rollers among the assembly of interdigitated rollers; and the respective timing pulley turns a respective drive shaft and engages respectively with a group of rollers in the interdigitated pattern of rollers.

11. The system of claim 8 wherein the interdigitated rollers create a roller surface comprising inter-roller gaps that reduce a spacing among the interdigitated rollers to facilitate a roller-to-roller transition with respect to each sheet of media among the sheets of media.

12. A method of operating a vacuum roller system, comprising:

creating a vacuum with a vacuum system; and moving sheets of media through a downstream dryer in a printer, wherein the vacuum is drawn between individual rollers among an assembly of interdigitated rollers comprising an interdigitated pattern of rollers comprising interlocked rollers that are clasped or interleaved, wherein the assembly of interdigitated rollers includes a plurality of shafts on which the interlocked rollers are located, wherein the plurality of shafts includes variable shaft spacing;

distributing with a vacuum plenum that covers a bottom of the assembly of interdigitated rollers, the vacuum plenum including a lower plenum, the vacuum provided by the vacuum system across a sheet of media among the sheets of media, wherein the vacuum is split around the individual rollers among the assembly of interdigitated rollers, wherein the vacuum is drawn between each individual roll among the individual rollers, wherein a distribution of the vacuum spreads pressure over the sheet of media in an even manner, wherein the vacuum plenum equalizes a pressure for the distribution of the vacuum in an even manner because of an irregular supply or an irregular demand; and adjusting through a control system linked to the assembly of interdigitated rollers comprising the interdigitated pattern of rollers, roll spacing among the rollers of the assembly of interdigitated rollers and the vacuum pressure based on media parameters input to the vacuum roller system from the control system.

13. The method of claim 12 adjusting a spacing between the individual rollers among the assembly of interdigitated rollers to vary the vacuum.

14. The method of claim 12 wherein the vacuum system is operable to change the vacuum drawn between the individual rollers among the assembly of interdigitated rollers.

15. The method of claim 12 further comprising creating a roller surface via the assembly of interdigitated rollers, the roller surface comprising inter-roller gaps that reduce a spacing among the interdigitated rollers to facilitate a roller-to-roller transition with respect to each sheet of media among the sheets of media.

16. The method of claim 12 further comprising creating a distribution vacuum that spreads pressure over the sheets of media in an even manner, wherein the distribution vacuum is facilitated by the vacuum plenum that covers the bottom of the assembly of interdigitated rollers.

17. The method of claim 12 further comprising driving the assembly of interdigitated rollers with a single drive system.

18. The method of claim 17 wherein the single drive system rotates the interdigitated rollers and allows for a roller spacing among the interdigitated rollers to be varied on a media-to-media basis or to facilitate optimizing the vacuum delivered to a surface of the media.

19. The method of claim 17 wherein the assembly of interdigitated rollers comprises a plurality of timing pulleys.

* * * * *